United States Patent [19]

Jones

[11] 4,455,228

[45] Jun. 19, 1984

[54] ROTARY MAGNETIC SEPARATORS

[76] Inventor: George H. Jones, 1 Trenawin La., Conner Downs, Hayle, Cornwall TR27 5JG, England

[21] Appl. No.: 425,968

[22] Filed: Sep. 28, 1982

[30] Foreign Application Priority Data

Nov. 16, 1981 [GB] United Kingdom ..... 8134506

[51] Int. Cl.[3] ..... B03C 1/30

[52] U.S. Cl. ..... 210/222; 209/214; 209/228; 209/232

[58] Field of Search ..... 210/222, 223; 209/214, 209/228, 232

[56] References Cited

U.S. PATENT DOCUMENTS 3,326,374 6/1967 Jones ..... 210/222

*Primary Examiner*—Frank Sever

*Attorney, Agent, or Firm*—Hopgood, Calimafde, Kalil, Blaustein & Judlowe

[57] ABSTRACT

A rotary magnetic separator in which there are 4, 6, 8 or any greater even number of rotor plates and at least one yoke structure having 4, 6, 8 or any greater even number of legs corresponding to the number of rotor plates, the legs being arranged in two sets having equal numbers. A winding structure is provided for each set and energized such that the legs of one set present an opposite polarity pole to the legs of the other set. The central section of the or each yoke structure has an enlarged cross-section area arranged in step-wise manner.

5 Claims, 9 Drawing Figures

ROTARY MAGNETIC SEPARATORS

FIELD OF THE INVENTION

The present invention relates to improvements in rotary magnetic separators, more particularly of the type disclosed in my U.S. Pat. No. 3,326,374.

DESCRIPTION ON THE PRIOR ART

In the rotary magnetic separator disclosed in my earlier Patent Specification referred to above solid magnetic particles are separated from a fluid in which they are suspended. The separator has gaps between walls made of magnetizable material which are caused to rotate so as to pass alternately through zones of strong and weak or zero magnetic field. The particle carrying fluid is passed through the gaps in the walls in zones of strong magnetic field so that the magnetic particles are caused to adhere to the walls of the gaps due to the presence of the magnetic field. A flow of washing fluid is passed through the gaps whilst they are still in the zones of strong magnetic field so that unwanted non-magnetic particles are removed from the walls. Next a flow of scouring fluid is forced through the gaps at a pressure sufficient to remove magnetic particles adhering to the walls of the gaps, when in zones of weak or zero magnetic field.

Such a rotary magnetic separator will hereinafter be referred to as the kind described.

One such separator of the kind described currently made under licence by KHD Industrieanlagen A.G. is shown in FIG. 1 of the accompanying drawings. The Jones machine is in the form of a double rotor structure, the whole structure being mounted within a frame 1 fabricated from structural steel. A pair of magnetic yokes 2 are mounted on the frame 1 and carry magnetic coils 3 at their ends, the magnetic coils being enclosed in air-cooled casings which are fixed to the frame. A rotor shaft 4 carries the two rotor discs 6 one above the other, the rotor shaft being supported in massive roller bearings. Plate boxes 7 are arranged around the periphery of each rotor disc, and as the rotor rotates each plate box is alternately carried into a strong magnetic field when it is adjacent a pole of a magnet and into a weak or zero magnetic field when it lies between two magnets. The drive for the rotor shaft 4 is located directly thereon, but is not shown for the sake of clarity. The drive comprises a worm gearing driven by an electric motor through V-belts.

The particle carrying fluid is fed into the plate boxes 7 through feed pipes 8 which are located at the positions where the plate boxes enter the zone of strong magnetic field. The washing fluid is fed into the plate boxes 7 through pipes 13 which are located at the positions where the plate boxes leave the zone of strong magnetic field. The scouring fluid is fed into the plate boxes 7 through pipes 14 which are located at the positions where the plate boxes are in the zone of weak or zero magnetic field.

Collecting launders 9 are provided under each rotor disc 6. The magnetic particles are discharged from pipes 10, whilst non-magnetic particles are discharged from the pipes 11. Middlings are discharged from the pipes 12.

The feed required is a thoroughly mixed slurry with particles 100% of small dimension. The pulp flows through the feed pipes 8 and into the plate boxes 7 at the leading edge of the magnetic poles. Feeding is continuous due to the rotation of the plate boxes. As shown each rotor has two symmetrically arranged feed points. Within the zones of strong magnetic field, the grooved plates of the plate boxes 7 concentrate the magnetic flux at the tips of the ridges. Within the zones of strong magnetic field the magnetic particles adhere to the plates whereas the non-magnetic particles pass straight through the plate boxes and exit through the pipes 11. Before leaving the magnetic field any entrained non-magnetic particles are washed-out by the washing fluid and exit through pipes 12. When the plate boxes reach the zone of weak or zero magnetic field, the adhering magnetic particles are removed from the plates by means of the scouring fluid and are collected through pipes 10.

The throughput of the largest Jones separators is approximately 180 metric tonnes per hour. Many of these large machines are currently in use in remote areas of the world such as the central plateau in Brazil. One of the problems of running a large ore extraction site in remote areas is the cost of the electricity to operate such a plant. Unless natural means are available on site to generate all the electricity for the plant, the necessary electric power must be generated on site and this means the use of expensive fossil fuels such as oil or coal. Again if such fuel is not available in the immediate locality it has to be transported over long distances which greatly adds to the overall cost of running such a large installation.

Not only is electric power required for rotating the enormous rotors and supplying the particle carrying fluid through the plate boxes of the rotor, it is also required for generating the intensely strong magnetic field necessity for separating the magnetic ore from the non-magnetic ore, as well as driving fans to cool the magnetic pole structures which tend to get very hot as a result of the high current flow in the windings.

SUMMARY OF THE INVENTION

It is therefore an object of the present invention to reduce the overall power consumption of the rotary magnetic separator and to increase the throughput without decreasing the efficiency of the separator.

According to the present invention there is provided a rotary magnetic separator of the kind described having n rotor structures, where n is an even number greater than 2, and a yoke structure in which each yoke has n legs, the legs being arranged in two sets of n/2, the legs of each set being energized by the same winding structure so that the legs of that set all present the same polarity pole to the associated rotor structures.

Each yoke may have a central section which has an enlarged cross-sectional area. The cross-sectional area of the central section may be enlarged in $n/2-1$ steps.

BRIEF DESCRIPTION OF THE DRAWINGS

The present invention will now be described in greater detail by way of examples with reference to the accompanying drawings, wherein.

FURTHER DESCRIPTION OF THE KNOWN JONES SEPARATOR

Figure 2A:
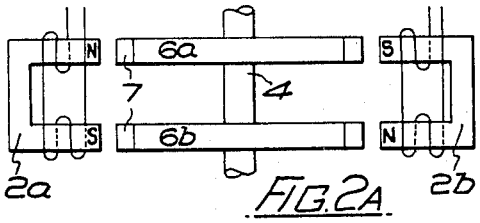
FIGS. 2A and 2B are respectively a diagrammatic cross-sectional elevation view of the rotor structure and associated magnetic pole structure: and a cross-sectional view of the coil structure of the known type of Jones magnetic separator as disclosed in FIG. 1, included here for the purpose of comparison.
Figure 2B:
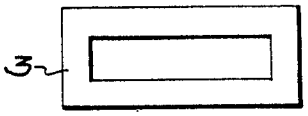

In the known Jones separator as manufactured by KHD Industrieanlagen A.G. as shown diagrammatically in FIG. 2A, the two rotor plates 6*a* and 6*b* are mounted on a common drive shaft 4 one above the other. Each rotor carries 27 plate boxes 7 around its circumference. This separator has two magnetic separating stations diametrically opposite to one another. Each station is provided with a magnetic structure having respective yoke 2*a* and 2*b*, the legs of the yoke each carrying a coil structure 3, whose cross-sectional shape is shown in FIG. 2B. The coil structure are so wound and interconnected in pairs on respective legs of the yokes 2*a* and 2*b*, that when energized with D.C., the upper leg of the yoke 2*a* and the lower leg of the yoke 2*b* both present a north pole to the rotor structure, whilst the upper leg of the yoke 2*a* both present a south pole to the north structure.

DESCRIPTION OF THE PREFERRED EMBODIMENTS

Figure 3A:
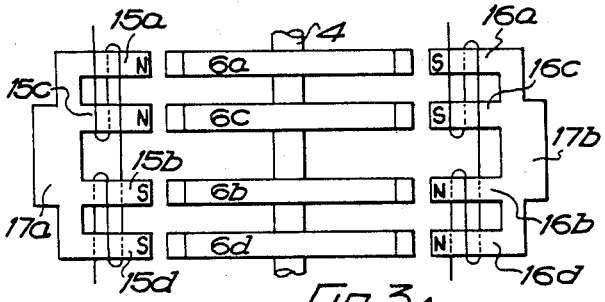
FIGS. 3A and 3B are similar views to FIGS. 2A and 2B of a first embodiment having four rotors.
Figure 3B:
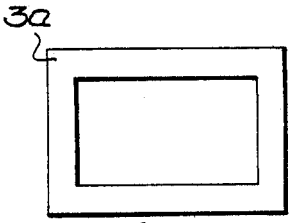

Referring now to the first embodiment shown in FIGS. 3A and 3B, it will be seen that the shaft 4 now carries four rotor plates, and upper pair 6*a* and 6*c* and a lower pair 6*b* and 6*d*. Likewise each yoke 2*a* or 2*b* has four legs. The first yoke 2*a* has pairs of legs 15*a*, 15*c* and 15*b*, 15*d*, whilst the second yoke 2*b* has pairs of legs 16*a*, 16*c* and 16*b*, 16*d*. The four pairs of legs each carry a coil structure 3*a*, whose cross-sectional shape is shown in FIG. 3B. The four coil structures are so wound and interconnected in pairs on the respective pairs of legs, that when energized with D.C., the two upper legs 15*a*, 15*c* of the yoke 2*a* and the two lower legs 16*b*, 16*d* of the yoke 2*b* present north poles to the rotor structure, whilst the two upper legs 16*a*, 16*c* of the yoke 2*b* and the two lower legs 15*b*, 15*d* of the yoke 2*a* present south poles to the rotor structure.

It will be noted that the cross-sectional area of the central sections of the two yokes are enlarged at 17*a* and 17*b* respectively in order to keep the magnetic reluctance to a minimum due to increased magnetic flux as a result of the double leg structure.

Figure 4A:
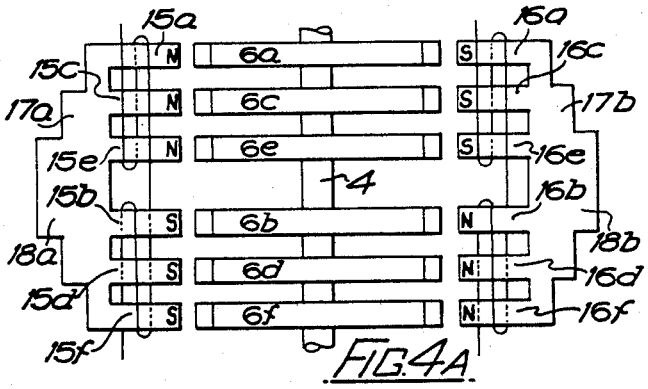
FIGS. 4A and 4B are similar views to FIGS. 2A and 2B of a second embodiment having six rotors.
Figure 4B:
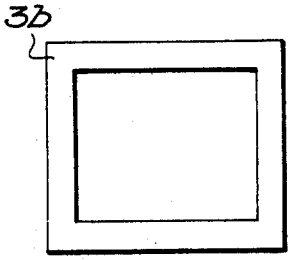

Referring now to the second embodiment shown in FIGS. 4A and 4B, it will be seen that the shaft 4 carries six rotor plates, an upper triplet 6*a*, 6*c*, 6*e* and a lower triplet 6*b*, 6*d*, 6*f*. Likewise each yoke 2*a* or 2*b* has six legs, the first yoke haivng two triplets of legs 15*a*, 15*c*, 15*e* and 15*b*, 15*d*, 15*f*, whilst the second yoke has two triplets of legs 16*a*, 16*c*, 16*e* and 16*b*, 16*d*, 16*f*. The four triplets of legs each carry a coil structure 3*b*, whose cross-sectional shape is shown in FIG. 4B. As in the first embodiment the upper triplet of legs on the first yoke 2*a* and the lower triplet of legs on the second yoke 2*b* present north poles to the rotor structure, whilst the upper triplet of legs on the second yoke 2*b* and the lower triplet of legs on the first yoke 2*a* present south poles to the rotor structure.

It will be noted that the cross-sectional area of the central sections of the two yokes are enlarged in a first step 17*a*, 17*b* and a second step 18*a*, 18*b*, respectively for the reasons given above in connection with the first embodiment.

Figure 5A:
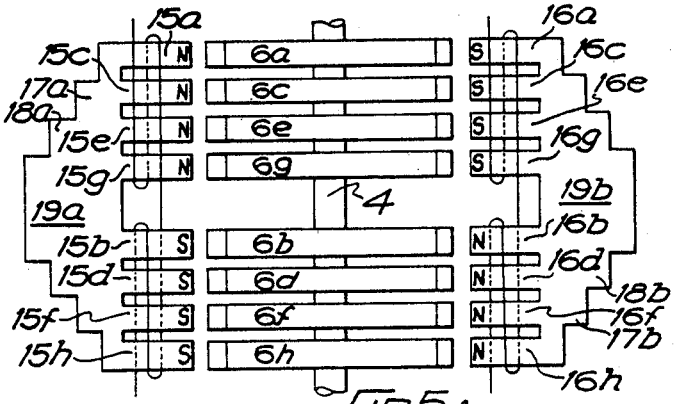
FIGS. 5A and 5B are similar views to FIGS. 2A and 2B of a third embodiment having eight rotors.
Figure 5B:
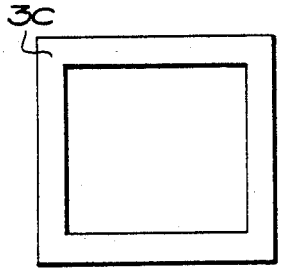

Referring now to the third embodiment shown in FIGS. 5A and 5B, it will be seen that the shaft 4 carries eight rotor plates, an upper quadruplet 6*a*, 6*c*, 6*e*, 6*g* and a lower quadruplet 6*b*, 6*d*, 6*f*, 6*h*. Likewise each yoke 2*a* or 2*b* has eight legs, the first yoke having two quadruplets of legs 15*a*, 15*c*, 15*e*, 15*g* and 15*b*, 15*d*, 15*f*, 15*h*, whilst the second yoke has two quadruplets of legs 16*a*, 16*c*, 16*e*, 16*g* and 16*b*, 16*d*, 16*f*, 16*h*. The four quadruplets of legs each carry a coil structure 3*c*, whose cross-sectional shape is shown in FIG. 5B. As in the first embodiment the upper quadruplet of legs on the first yoke 2*a* and the lower quadruplet of legs on the second yoke 2*b* present north poles to the rotor structure, whilst the upper quadruplet of legs on the second yoke 2*b* and the lower quadruplet of legs on the first yoke 2*a* present south poles to the rotor structure.

Again, it will be noted that the cross-sectional area of the central sections of the two yokes are enlarged as shown in FIG. 5B. There are now three stepped portions, a first portion 17*a*, 17*b*, a second portion 18*a*, 18*b* and a central portion 19*a*, 19*b* where the cross-sectional area is the greatest.

In the structure of the known Jones separator as currently manufactured by KHD Industrieanlagen A.G. as shown in FIG. 2A as well as the three embodiments shown in FIGS. 3A, 4A and 5B, the complete coil structures have not been included for the sake of clarity. However, for the purposes of illustration one coil turn has been shown around the legs of each yoke 2*a* and 2*b* in order to indicate the polarity of the pole to be presented to the rotor plates. For example in the third embodiment shown in FIG. 5A, in the upper section of the structure, the legs 15*a*, 15*c*, 15*e* and 15*g* of the yoke 2*a* all present a north pole to the respective rotor plates 6*a*, 6*c*, 6*e*, and 6*g*, whereas the legs 16*a*, 16*c*, 16*e* and 16*g* of the yoke 2*b* will all present south poles to the diametrically opposite sides of the rotor plates 6*a*, 6*c*, 6*e* and 6*g*. In the lower section of the structure, the legs 15*b*, 15*d*, 15*f* and 15*h* all present south poles and the legs 16*b*, 16*d*, 16*f* and 16*h* all present north poles of diametrically opposite sides of the rotor plates 6*b*, 6*d*, 6*f* and 6*h*.

Also whilst in the preferred embodiments described above, two yoke structure are employed which are arranged diametrically opposite one another with respect to the rotor plates, it will be appreciated that 4, 6, 8 . . . m such structures can be arranged in equi-spaced relation around the rotor plates in a manner as disclosed in my prior U.S. Pat. No. 3,326,374. Likewise, the invention may only provide one such yoke structure, although in general such a construction would be less economical to operate.

Comparing the coil structure of the known two rotor separator shown in FIGS. 2A and 2B, with the coil structure of the eight rotor separator of similar rotor size shown in FIGS. 5A and 5B, the mean dimensions of the coil structures are as follows.

2 rotor machine: approximately 2900 mm by 500 mm.

8 rotor machine: approximately 2900 mm by 2400 mm.

The mean length of one turn is as follows.

2 rotor machine: approximately 6800 mm.

8 rotor machine: approximately 10,600 mm

For the eight rotor machine the weight of the coil structures and power consumption is between half and one third of that for the two rotor machine, per rotor or per unit throughput. It will be appreciated that relative savings of the eight rotor separator compared with the two rotor separator will vary with rotor diameter being less with smaller rotors and more with larger rotors.

Figure 1:
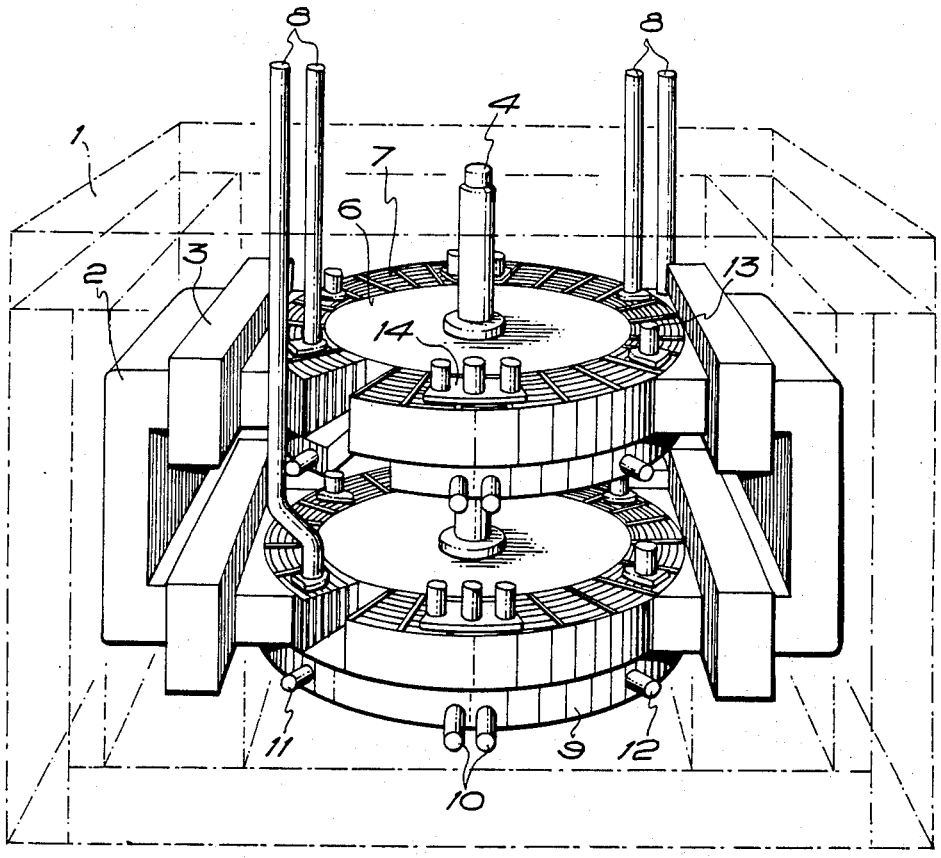
FIG. 1 is a diagrammatic representation of a known JONES rotary magnetic separator currently made under licence by KHD Industrienanlagen A.G. referred to above.

The equipment for supplying the particle carrying fluid, the washing fluid, and the scouring fluid to the plate boxes in the four rotor separator shown in FIG. 4A and the eight rotor separator shown in FIG. 5A are basically similar to those of the known two rotor machine shown in FIG. 1 and 2A.

The particle carrying fluid may be supplied to each rotor so that the throughput of an eight rotor separator is four times that of a two rotor separator. Alternatively, the particle carrying fluid may be supplied to some of the rotors and the products therefrom supplied to the remaining rotors for retreatment.

Furthermore, it should be noted that for any one rotor in the three embodiments described above, the equipment opposite one pole may be used separately to the equipment opposite the other pole.

As in the various embodiments disclosed in my U.S. Pat. No. 3,326,374, instead of each rotor being associated with only a pair of diametrically positioned poles, there may be four, six or eight alternatively arranged north and south poles with each rotor.

In connection with the shape and size of the coil structures referred to above it will be appreciated that whilst the coils of the known double rotor separator disclosed in FIGS. 2A and 2B are of great width in comparison to their small depth, those for the four, six and eight rotor separators shown in FIGS. 3, 4 and 5 respectively progressively get squarer.

The cost and power consumption of a coil is approximately proportional to the turn length whilst the total useful magnetizing effect of the coil is proportional to the cross-sectional area inside the coil, assuming the same current and the same number of turns in all cases.

Thus, the greater the number of rotors and associated number of legs forming a split hole, the lower the length of the turn per rotor, and the lower the capital cost of the coil and operating costs per rotor.

Accordingly, not only can the throughput be greatly increased by the use of the above described embodiments over the known double rotor structure as at present manufactured, but the capital costs and operating costs per rotor can be greatly reduced without in any way affecting the efficiency of the magnetic separation process.

Whilst it may prove that the case of the third embodiment where $n=8$ is both the most economical to build and operate, in theory there is no limitation to the number of rotor plates and yoke structure which may be employed, although practical difficulties may arise in connection with the size of the winding structure which would have to be employed.

What is claimed is:

1. A rotary magnetic separator of the kind described, said separator including: a common drive shaft; a pair of rotor plates mounted on the common drive shaft; at least two magnetic separating stations arranged diametrically opposite one another; a magnetic yoke structure associated with each station, each structure having a pair of legs which cooperate with respective rotor plates, and a winding associated with each leg such that when said windings are energized, the legs are of opposite magnetic polarity;

characterized by means for maximizing throughput while minimizing energy consumption, said means including:

(a) means for providing the number of rotor plates to the extent of an even number greater than 2, the rotor plates being arranged in two sets one above the other on the common shaft;

(b) means for providing each magnetic yoke structure with a number of legs which is an even number greater than 2, the legs being arranged in two sets for cooperation with the respective sets of rotor plates;

(c) means for providing a winding for each set of legs, the windings being arranged such that when energized, all the legs of one set have one magnetic polarity and all the legs of the other set have the opposite polarity; and (d) means for providing each magnetic yoke structure with at least one enlarged cross-section in the radial direction in its central zone.

2. A rotary magnetic separator according to claim 1, wherein the cross sectional area of each magnetic yoke is enlarged in the radial direction in $n/2-1$ steps from its top and bottom towards the central zone, where n is the number of legs in the yoke structure.

3. A rotary magnetic separator according to claim 2, wherein each step of increased cross-sectional area in the radial direction coincides with the position of a leg in the magnetic yoke structure.

4. A rotary magnetic separator according to claim 1, wherein there are an even number greater than 2 of magnetic yoke structures arranged around the periphery of the rotor plates in equi-spaced relation to form an even numbered plurality of magnetic ore separating stations, the pairs of legs of the magnetic yoke structures having opposite magnetic polarities around the separator.

5. A rotary magnetic separator according to claim 1, wherein the number of rotor plates and also the corresponding number of legs on each magnetic yoke structure is selected from the group of even numbers comprising 4, 6 and 8.

* * * * *